US011739916B2

(12) United States Patent
Chen et al.

(10) Patent No.: US 11,739,916 B2
(45) **Date of Patent: *Aug. 29, 2023**

(54) LIGHTING APPARATUS

(71) Applicant: LEEDARSON LIGHTING CO.,LTD., Fujian (CN)

(72) Inventors: Yizhen Chen, Fujian (CN); Zhenyu Tang, Fujian (CN); Shuxing Gao, Fujian (CN); Xu Wu, Fujian (CN)

(73) Assignee: LEEDARSON LIGHTING CO.,LTD., Fujian (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/077,815

(22) Filed: Dec. 8, 2022

(65) Prior Publication Data

US 2023/0104296 A1 Apr. 6, 2023

Related U.S. Application Data

(63) Continuation of application No. 17/684,669, filed on Mar. 2, 2022, now Pat. No. 11,549,668.

(30) Foreign Application Priority Data

Mar. 2, 2021 (CN) ..... CN202120453003
Mar. 2, 2021 (CN) ..... CN202120454082

(51) Int. Cl.

| | |
|---|---|
| ***F21V 19/00*** | (2006.01) |
| ***F21S 8/02*** | (2006.01) |
| ***F21V 17/02*** | (2006.01) |
| ***F21V 17/06*** | (2006.01) |
| ***F21V 7/00*** | (2006.01) |
| ***F21Y 115/10*** | (2016.01) |

(52) U.S. Cl.
CPC ..... *F21V 19/004* (2013.01); *F21S 8/026* (2013.01); *F21V 7/0066* (2013.01); *F21V 17/02* (2013.01); *F21V 17/06* (2013.01); *F21Y 2115/10* (2016.08)

(58) Field of Classification Search
CPC .. F21S 8/02; F21S 8/028; F21V 7/006; F21V 17/02–06; F21V 19/003–0055; F21Y 2115/10
See application file for complete search history.

(56) References Cited

U.S. PATENT DOCUMENTS 10,697,599 B1 * 6/2020 Davis ..... F21V 21/30

* cited by examiner

*Primary Examiner* — Jason M Han
(74) *Attorney, Agent, or Firm* — Chun-Ming Shih; LANWAY IPR SERVICES

(57) ABSTRACT

A lighting apparatus includes a fixing unit, a lamp body, a base housing and multiple elastic units. The fixing unit has a central hole. The lamp body includes an inner semi-sphere housing, a rotation shaft and a light source. The base housing includes an external semi-sphere housing and a rotation connector. The rotation shaft is coupled to the rotation connector for the lamp body to rotate with respect to the base housing along a first rotation axis of the rotation shaft. The multiple elastic units are attached to the base housing. The multiple elastic units are elastically attached to the central hole for the base housing to rotate with respect to the fixing unit along a second axis. There is a tilt angle between the first rotation axis and the second rotation axis.

20 Claims, 12 Drawing Sheets

Fig, 2

LIGHTING APPARATUS

RELATED APPLICATION

The present application is a continued application of U.S. patent application Ser. No. 17/684,669.

FIELD

The present invention is related to a lighting apparatus, and more particularly related to a lighting apparatus with a flexible light direction.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

It is useful if a light device may be adjusted for its light direction. However, most downlight devices are installed to a cavity or a junction box. In such case, it is not easy to design a light device with a movable structure.

Therefore, it is beneficial to design a light device that is easy to be assembled while easy to be adjusted for light direction and other settings. It is useful if a light device may be adjusted for its light direction. However, most downlight devices are installed to a cavity or a junction box. In such case, it is not easy to design a light device with a movable structure.

Therefore, it is beneficial to design a light device that is easy to be assembled while easy to be adjusted for light direction and other settings. It is useful if a light device may be adjusted for its light direction. However, most downlight devices are installed to a cavity or a junction box. In such case, it is not easy to design a light device with a movable structure.

Therefore, it is beneficial to design a light device that is easy to be assembled while easy to be adjusted for light direction and other settings. It is useful if a light device may be adjusted for its light direction. However, most downlight devices are installed to a cavity or a junction box. In such case, it is not easy to design a light device with a movable structure.

Therefore, it is beneficial to design a light device that is easy to be assembled while easy to be adjusted for light direction and other settings.

SUMMARY

In some embodiments, a lighting apparatus includes a fixing unit, a lamp body, a base housing and multiple elastic units.

The fixing unit has a central hole.

The lamp body includes an inner semi-sphere housing, a rotation shaft and a light source.

The base housing includes an external semi-sphere housing and a rotation connector.

The rotation shaft is coupled to the rotation connector for the lamp body to rotate with respect to the base housing along a first rotation axis of the rotation shaft.

The multiple elastic units are attached to the base housing.

The multiple elastic units are elastically attached to the central hole for the base housing to rotate with respect to the fixing unit along a second axis.

There is a tilt angle between the first rotation axis and the second rotation axis.

In some embodiments, the fixing unit is an elongated plate with a central part and two end parts.

The two end parts are fixed to an installation platform.

The central part defines the central hole.

The installation platform defines the installation hole.

In some embodiments, the multiple elastic units each has a bending part.

The bending parts of the multiple elastic units are pressed to decrease a neck diameter of the bending parts to enter the central hole.

The when the bending parts of the multiple elastic units are released, the neck diameter is expanded to keep the multiple elastic units in the central hole.

In some embodiments, the external semi-sphere housing has multiple sockets for respectively inserting the multiple elastic units.

In some embodiments, the base housing has an external rim concealing an installation hole for installing the lighting apparatus.

In some embodiments, the external rim includes a metal material.

A ground end of the light source is connected to the external rim.

In some embodiments, a manual switch is disposed on an exterior side of the external rim for a user to manually adjust a setting of the light source.

The manual switch is coupled to the light source via the rotation shaft.

In some embodiments, an antenna module is disposed on an exterior side of the rim.

The antenna module is coupled to the light source via the rotation shaft.

In some embodiments, the light source includes a light source plate, a LED module and a driver circuit.

The LED module and the driver circuit are placed on the light source plate.

In some embodiments, a protection wall is disposed between the LED module and the driver circuit.

In some embodiments, the protection wall has a reflective layer facing to the LED module.

In some embodiments, reflective layer has a curve surface for scattering a light of the LED module emitted on the reflective layer.

In some embodiments, the protection wall includes a metal material for carrying heat away to a heat sink.

In some embodiments, a reflective cup and a light passing cover are attached to the inner semi-sphere housing.

In some embodiments, the light passing cover has a lens.

The light passing cover is adjustable to change a distance between the lens and the light source to change a diameter of a light beam.

In some embodiments, the rotation shaft has a wiring hole for a connecting wire to pass through.

The connecting wire connects the light source to an external power.

In some embodiments, the connecting wire is fixed to a wire limiting structure to prevent pulling of the connecting wire.

In some embodiments, the connecting wire passes through the central hole of the fixing unit.

In some embodiments, the rotation shaft has a wire socket for connecting to a power wire.

In some embodiments, the multiple elastic units are three elastic clips.

DETAILED DESCRIPTION

Figure 10:
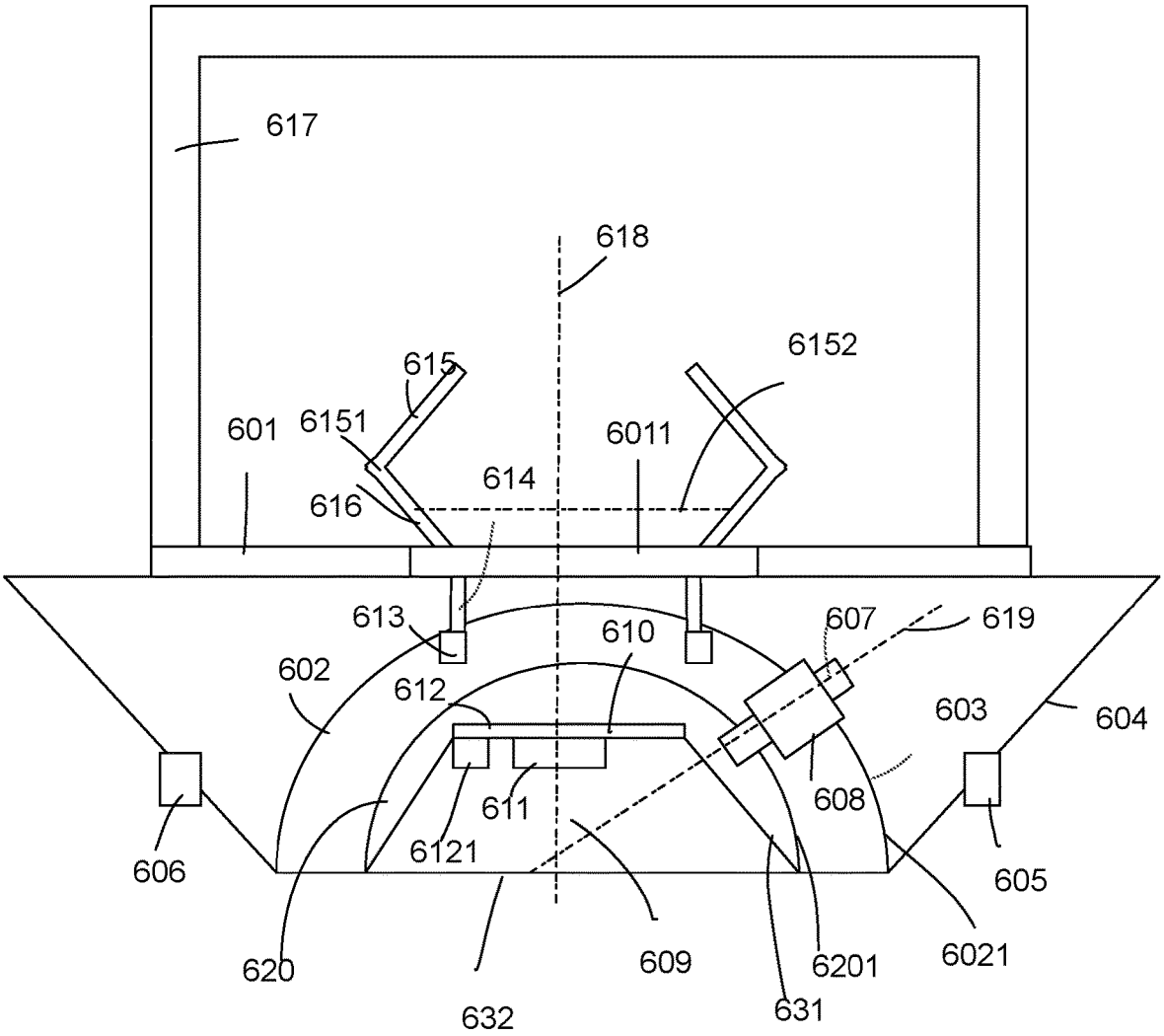
FIG. 10 shows another lighting apparatus embodiment.

In FIG. 10, a lighting apparatus includes a fixing unit 601, a lamp body 620, a base housing 602 and multiple elastic units 615.

The fixing unit 601 has a central hole 6011.

The lamp body 620 includes an inner semi-sphere housing 6201, a rotation shaft 607 and a light source 610.

The base housing 602 includes an external semi-sphere housing 6021 and a rotation connector 608.

In some embodiments, the rotation shaft 607 is coupled to the rotation connector 608. In addition, the rotation shaft 607 is movable along a first rotation axis 619.

The rotation shaft 607 is coupled to the rotation connector 608 for the lamp body 620 to rotate with respect to the base housing 602 along a first rotation axis 619 of the rotation shaft 607.

The multiple elastic units 615 are attached to the base housing 602.

The multiple elastic units 615 are elastically attached to the central hole 6011 for the base housing 602 to rotate with respect to the fixing unit 601 along a second axis 618.

There is a tilt angle 609 between the first rotation axis 609 and the second rotation axis 618. In some embodiments, the rotation axis 609 is less than 70 degrees.

In some embodiments, the fixing unit 601 is an elongated plate with a central part and two end parts.

Figure 9:
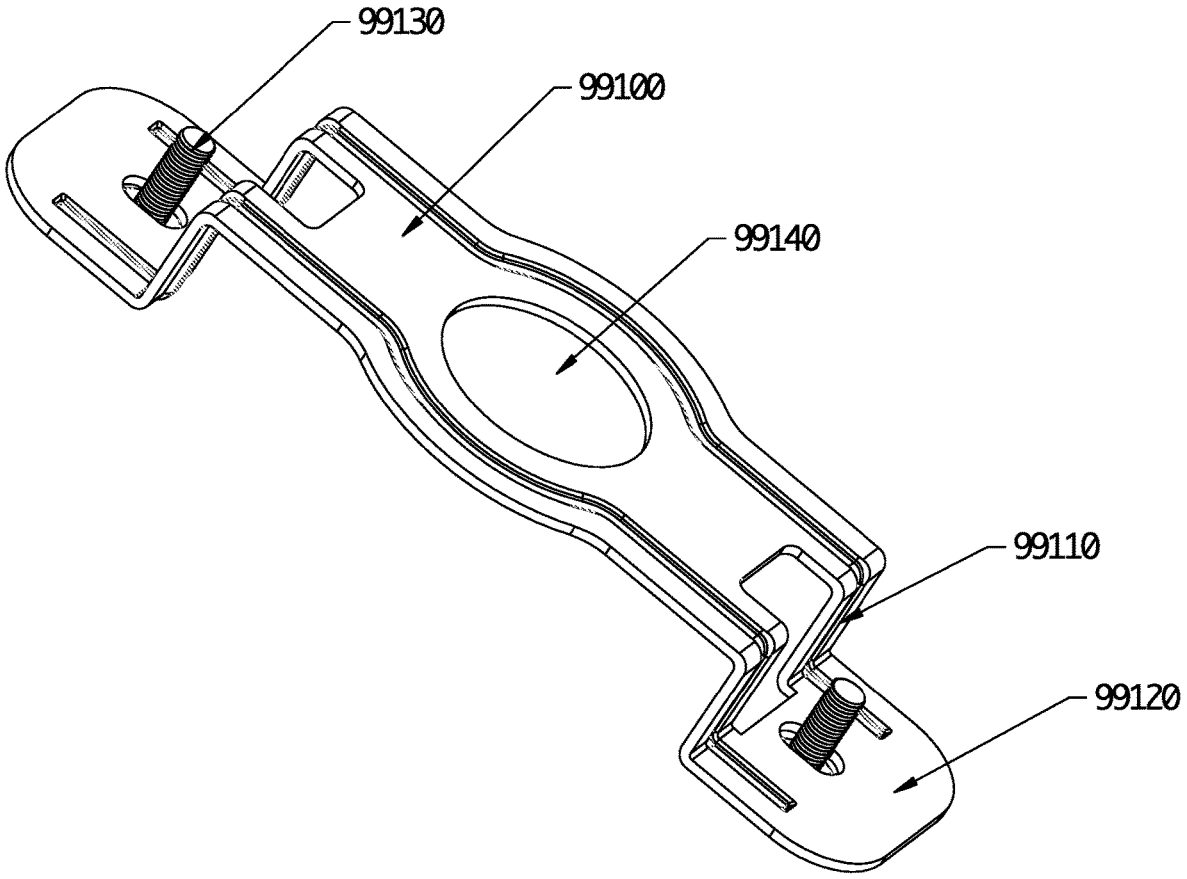
FIG. 9 illustrates an fixing unit example.

FIG. 9 shows an example of the fixing unit that includes a central part 99100 and two end parts 99120. Screws 99130 are used for fixing the fixing unit to an installation platform, e.g. a junction box or a cavity in a ceiling. The central hole 99140 is disposed in the central part 99110 of the fixing unit. There is a bending portion 99110 to reserve a space for holding components of the lighting apparatus.

The two end parts are fixed to an installation platform.

The central part defines the central hole.

The installation platform defines the installation hole.

In FIG. 10, the multiple elastic units 615 each has a bending part 6151.

The bending parts 6151 of the multiple elastic units 615 are pressed to decrease a neck diameter 6152 of the bending parts 6151 to enter the central hole 6011.

When the bending parts 6151 of the multiple elastic units are released, the neck diameter 6152 is expanded to keep the multiple elastic units in 615 the central hole 6011.

In some embodiments, the external semi-sphere housing 6021 has multiple sockets 613 for respectively inserting the multiple elastic units 615.

In some embodiments, the base housing 602 has an external rim 604 concealing an installation hole 617 for installing the lighting apparatus.

In some embodiments, the external rim 604 includes a metal material.

A ground end of the light source 610 is connected to the external rim 604.

In some embodiments, a manual switch 606 is disposed on an exterior side of the external rim 604 for a user to manually adjust a setting of the light source 610.

The manual switch 606 is coupled to the light source 610 via the rotation shaft 607. For example, the rotation shaft 607 may be a tubular structure with a wiring hole to allow a wire to pass through.

In some embodiments, an antenna module 606 is disposed on an exterior side of the external rim 604.

The antenna module 606 is coupled to the light source 610 via the rotation shaft 607.

In some embodiments, the light source 610 includes a light source plate 612, a LED module 611 and a driver circuit 6121.

The LED module 611 and the driver circuit 6121 are placed on the light source plate 612.

Figure 11:
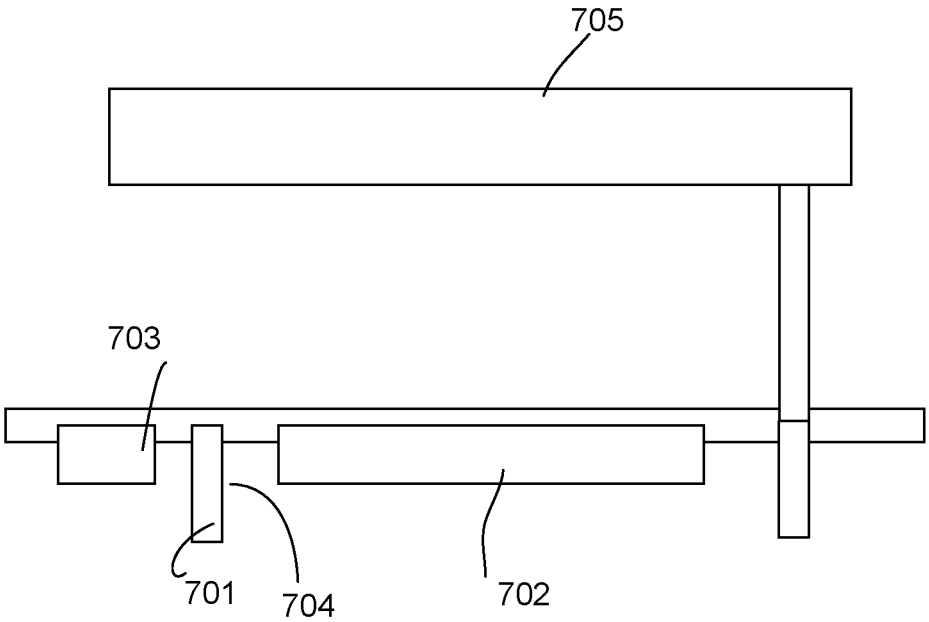
FIG. 11 shows a thermal path for heat dissipation.

In FIG. 11, a protection wall 701 is disposed between the LED module 702 and the driver circuit 703.

In some embodiments, the protection wall 701 has a reflective layer 704 facing to the LED module 702.

In some embodiments, reflective layer 704 has a curve surface for scattering a light of the LED module 702 emitted on the reflective layer 704.

In some embodiments, the protection wall 701 includes a metal material for carrying heat away to a heat sink 705.

In FIG. 10, a reflective cup 631 and a light passing cover 632 are attached to the inner semi-sphere housing 6021.

In some embodiments, the light passing cover 632 has a lens.

The light passing cover 631 is adjustable to change a distance between the lens and the light source 610 to change a diameter of a light beam. For example, the lens is a condensing lens for forming a light beam. A rotation structure may be used to change the distance between the light source 610 and the lens.

In some embodiments, the rotation shaft 607 has a wiring hole for a connecting wire to pass through.

The connecting wire connects the light source to an external power.

In some embodiments, the connecting wire is fixed to a wire limiting structure to prevent pulling of the connecting wire.

In some embodiments, the connecting wire passes through the central hole of the fixing unit.

Figure 12:
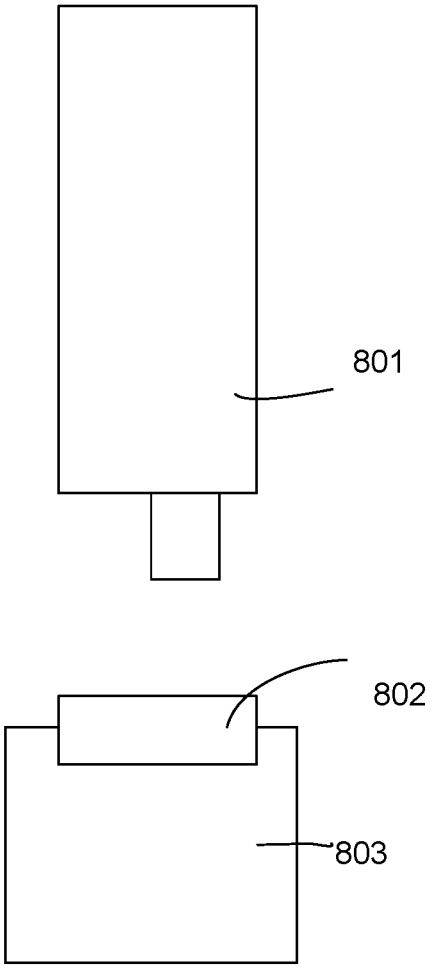
FIG. 12 shows a rotation shaft with a socket.

In FIG. 12, the rotation shaft 803 has a wire socket 802 for connecting to a power wire 801.

In some embodiments, the multiple elastic units are three elastic clips.

Figure 1:
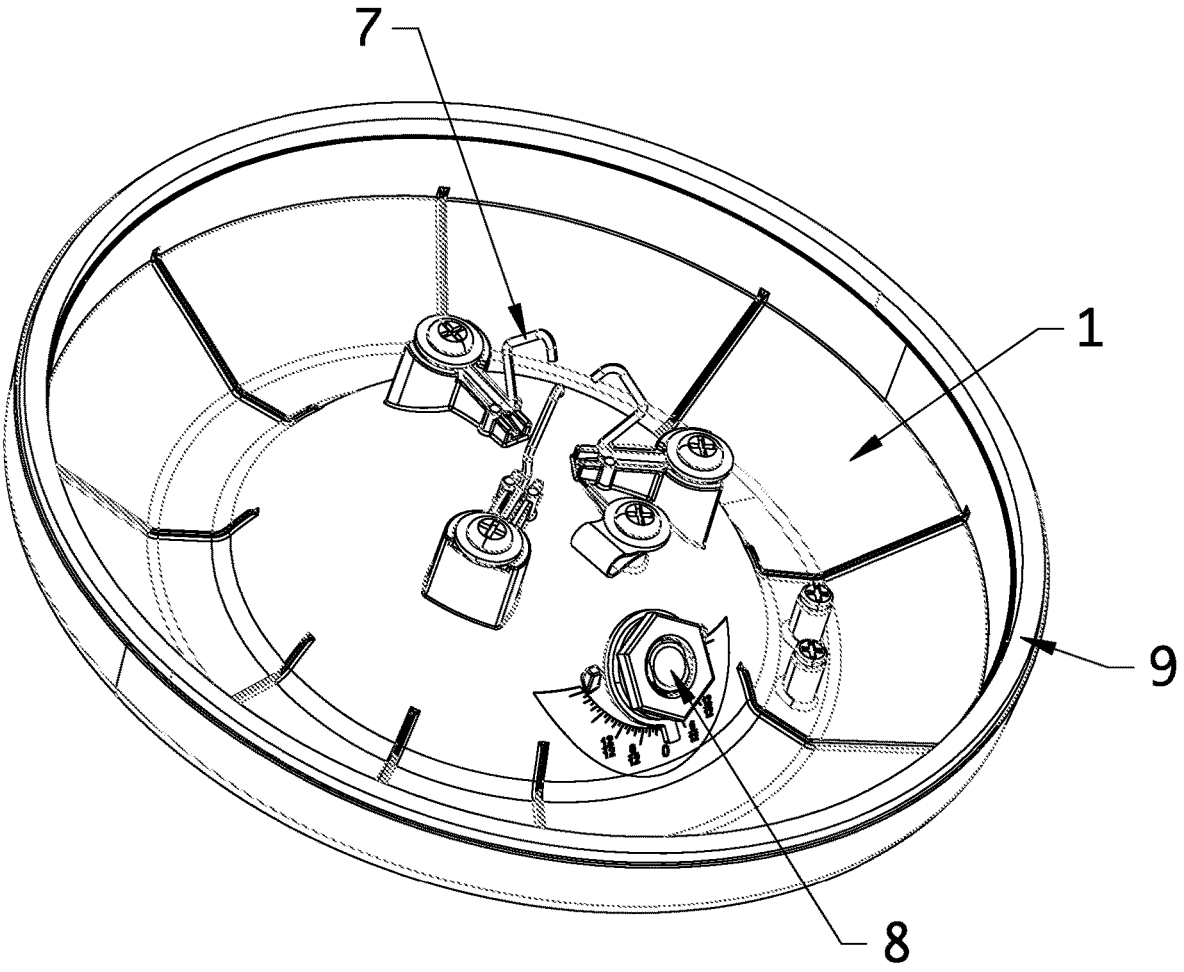
FIG. 1 illustrates a lighting apparatus.

Please refer to FIG. 1, which shows a lighting apparatus embodiment.

In FIG. 1, the lighting apparatus has a rotation shaft 8, multiple elastic units 7, a foam ring and an external rim 1.

Figure 2:
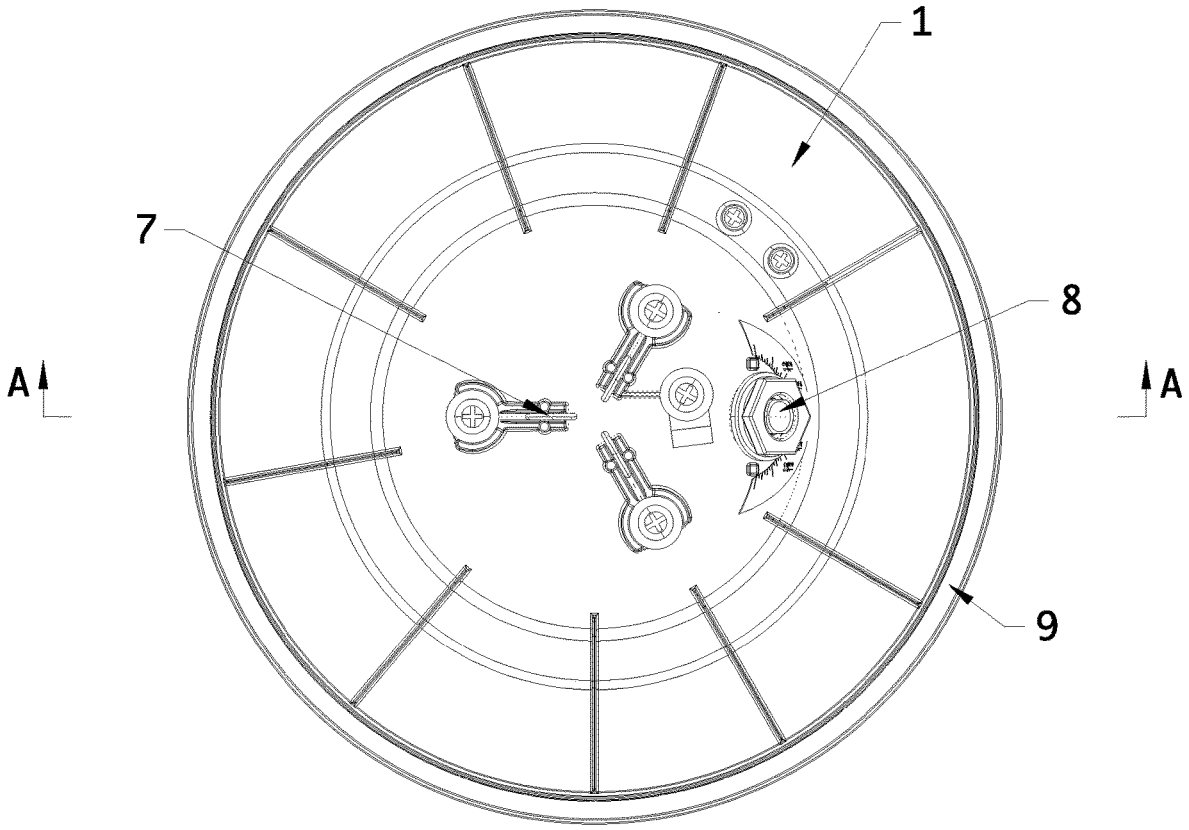
FIG. 2 illustrates a top view of the example in FIG. 1.

FIG. 2 shows a top view of the example in FIG. 1. In the following description and drawings mentioned, the same reference numerals refer to the same components and may not be described again for brevity.

Figure 3:
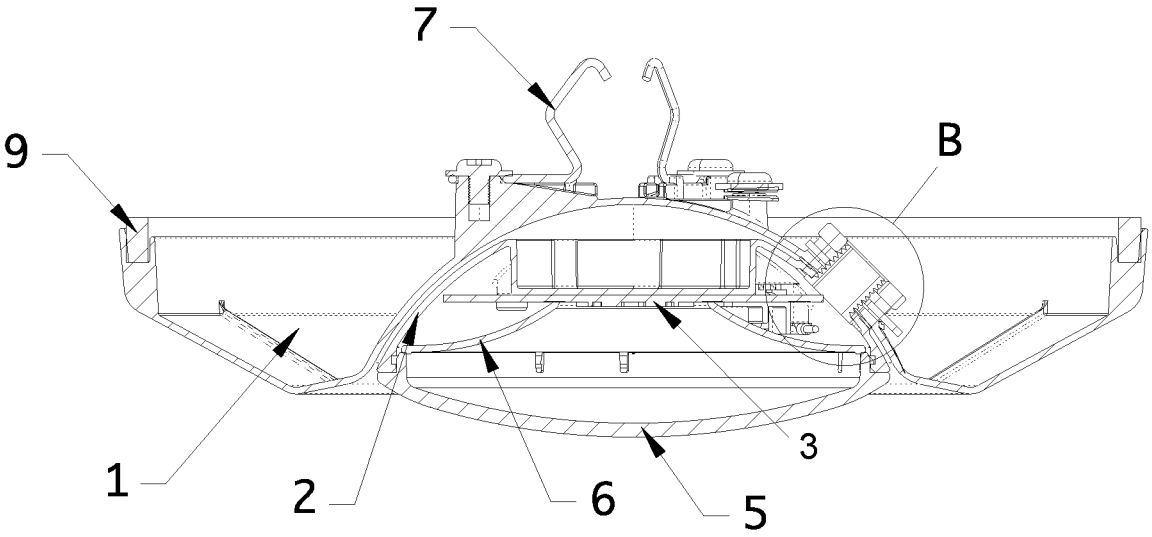
FIG. 3 illustrates a side view of the example in FIG. 1.

FIG. 3 shows a cross-sectional view of the example in FIG. 1.

In FIG. 3, a light source 3 is placed in a lamp body 2. The lamp body 2 has a reflective cup 6. There is a light passing cover 5 for protecting and may also be used for scattering light of the light source 3.

Figure 4:
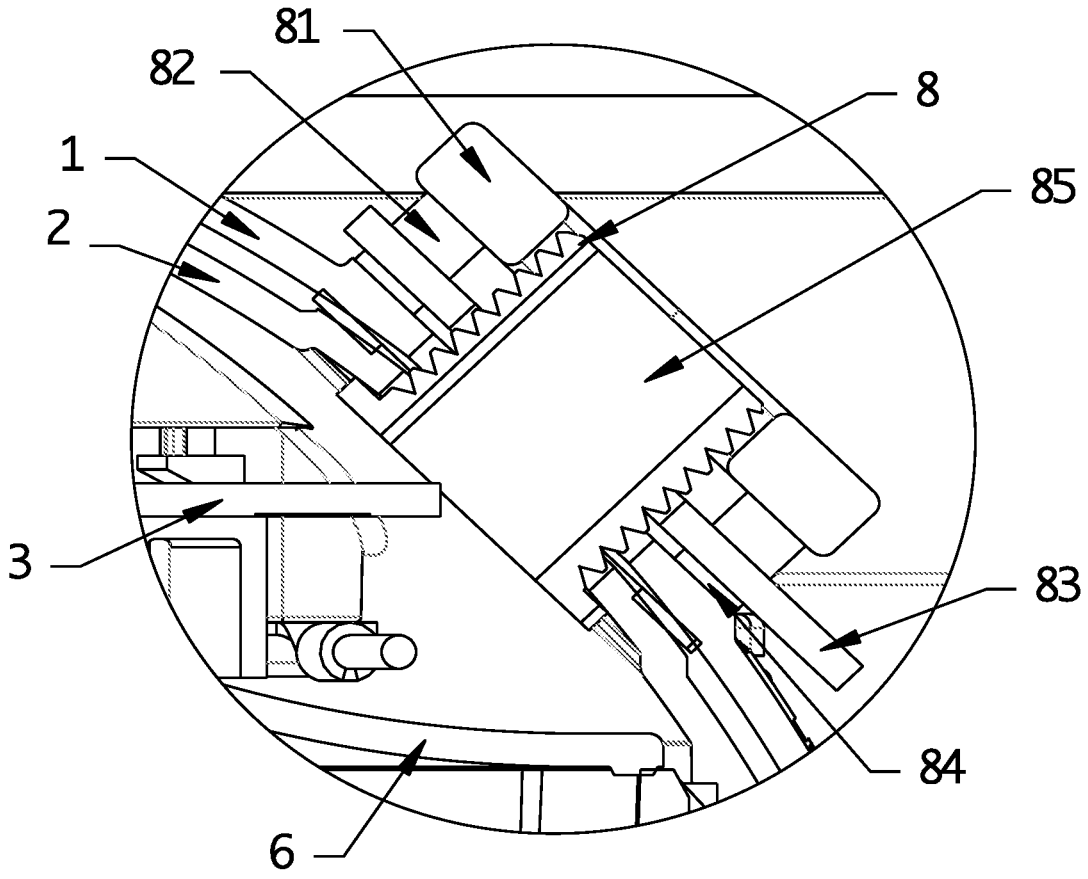
FIG. 4 illustrates a zoom-up view of a portion of the example in FIG. 1.

FIG. 4 shows an example of a rotation shaft and a corresponding rotation connector as mentioned above.

The rotation shaft 8 has a wiring hole 85 for a wire to pass through. The wire may be used for carrying electricity and may also be used for carrying control signals.

There is a wave shape ring pad 82 for providing a segmental rotation. For example, there are 20 protruding wave structures and that makes 20 candidate rotation positions.

There are some padding rings 84 for enhancing friction force to stabilize the rotation.

There is screw bolt 81. A reflective cup 6 is placed for guiding light to enhance light efficiency.

Figure 5:
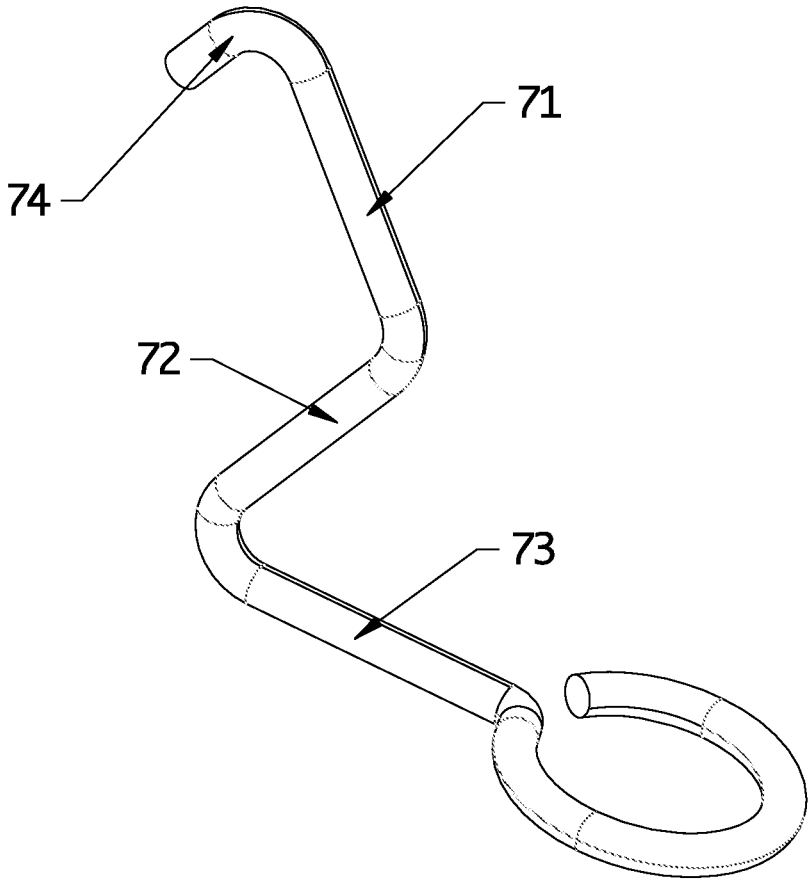
FIG. 5 illustrates an elastic unit example.

FIG. 5 shows an elastic unit example. There are four parts 71, 72, 74, 73 in the elastic unit example. Three bending parts are used to form the four parts 71, 72, 73, 74. As mentioned above, the elastic units are operable to attach or detach the lighting apparatus from a fixing unit that is fixed to an installation platform in advance.

Figure 6:
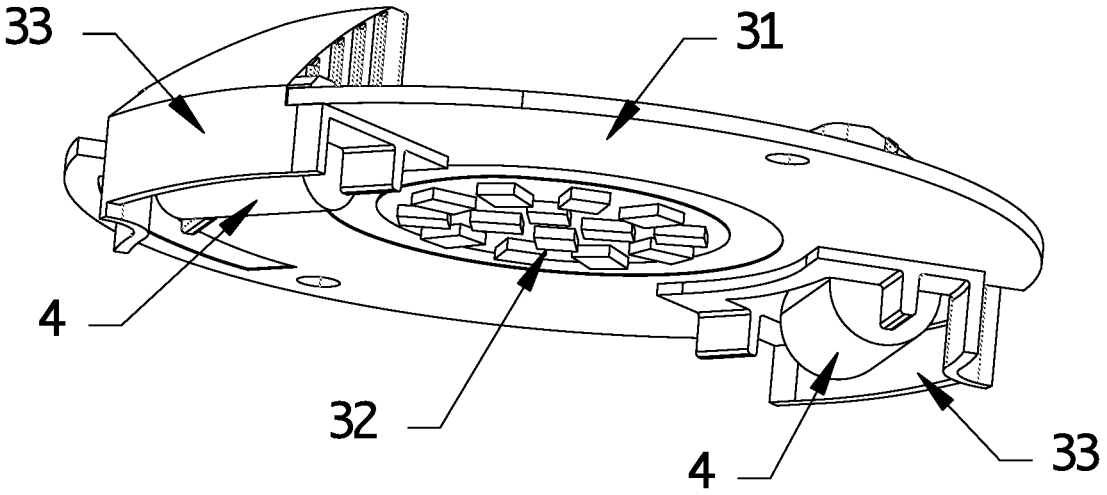
FIG. 6 illustrates a light source example.

FIG. 6 shows a light source example. In FIG. 6, a light source plate is mounted with a LED module 32. There are driver circuits 4 enclosed by a protection wall 33 that separates the LED module 32 and the driver circuit 4.

Figure 7:
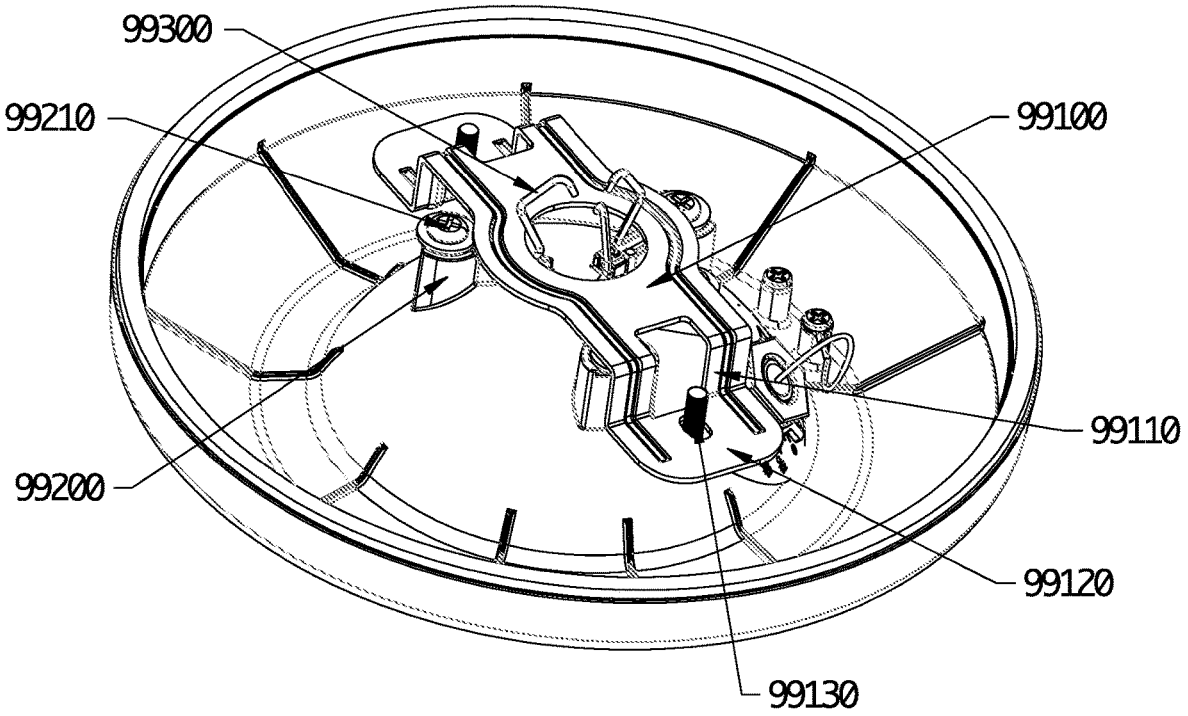
FIG. 7 illustrates an example showing a fixing unit in a lighting apparatus embodiment.

FIG. 7 shows a fixing unit 99100 with a bending part 99110 for bending two end parts 99120. Screws 99130 are used for fixing the fixing unit to an installation platform. The elastic units 99300 are pressed to enter a central hole of the fixing unit.

There are sockets 99200 for inserting the elastic units 99300. Screws 99210 are used for fixing the elastic units 99300 to the sockets 99200.

Figure 8:
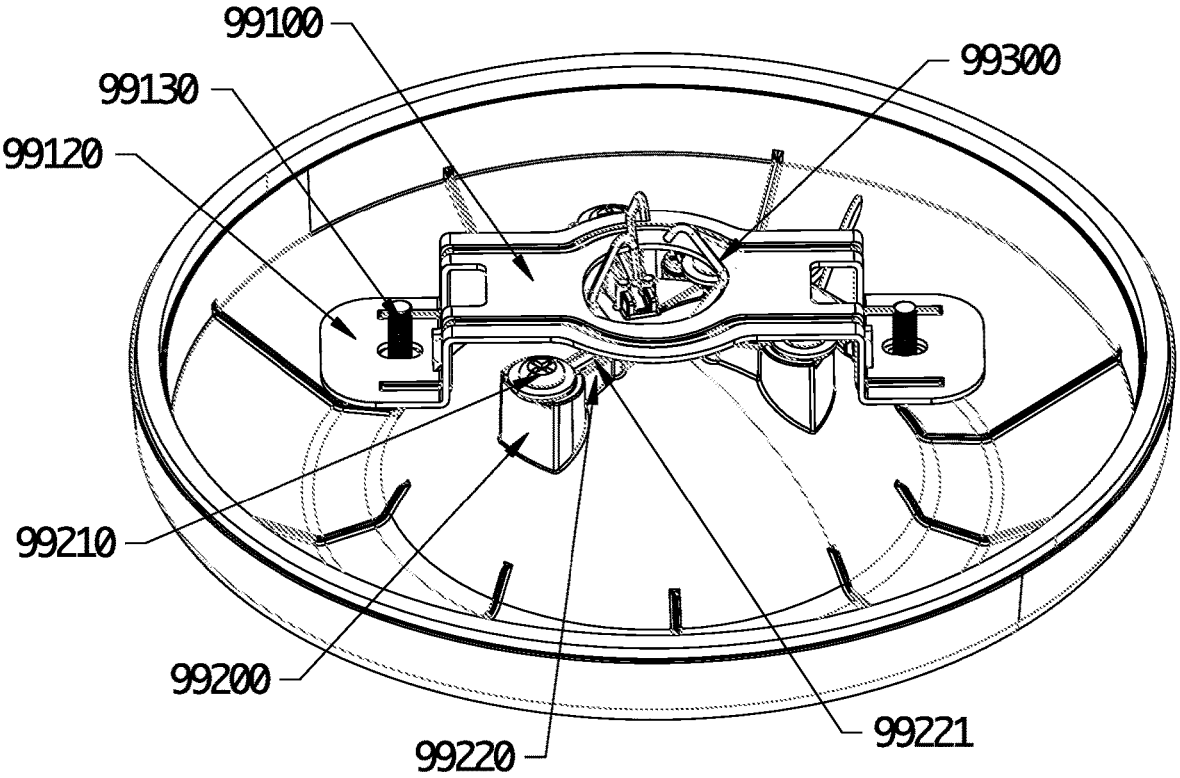
FIG. 8 illustrates another view of the example in FIG. 7.

FIG. 8 shows an example for rotating the base housing with respect to the fixing unit.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a fixing unit with a central hole;

a lamp body comprising an inner semi-sphere housing, a rotation shaft and a light source;

a base housing comprising an external semi-sphere housing and a rotation connector, wherein the rotation shaft is coupled to the rotation connector for the lamp body to rotate with respect to the base housing along a first rotation axis of the rotation shaft; and an elastic unit attached to the base housing, wherein the elastic unit is elastically attached to the central hole for the base housing to rotate with respect to the fixing unit along a second rotation axis, wherein there is a tilt angle between the first rotation axis and the second rotation axis.

2. The lighting apparatus of claim 1, wherein the fixing unit is an elongated plate with a central part and two end parts, wherein the two end parts are fixed to an installation platform, wherein the central part defines the central hole, wherein the installation platform defines the installation hole.

3. The lighting apparatus of claim 2, wherein there are multiple elastic units that each has a bending part, wherein the bending parts of the multiple elastic units are pressed to decrease a neck diameter of the bending parts to enter the central hole, wherein the when the bending parts of the multiple elastic units are released, the neck diameter is expanded to keep the multiple elastic units in the central hole.

4. The lighting apparatus of claim 3, wherein the external semi-sphere housing has multiple sockets for respectively inserting the multiple elastic units.

5. The lighting apparatus of claim 1, wherein the base housing has an external rim concealing an installation hole for installing the lighting apparatus.

6. The lighting apparatus of claim 5, wherein the external rim comprises a metal material, wherein a ground end of the light source is connected to the external rim.

7. The lighting apparatus of claim 5, wherein a manual switch is disposed on an exterior side of the external rim for a user to manually adjust a setting of the light source, wherein the manual switch is coupled to the light source via the rotation shaft.

8. The lighting apparatus of claim 5, wherein an antenna module is disposed on an exterior side of the rim, wherein the antenna module is coupled to the light source via the rotation shaft.

9. The lighting apparatus of claim 1, wherein the light source comprises a light source plate, a LED module and a driver circuit, wherein the LED module and the driver circuit are placed on the light source plate.

10. The lighting apparatus of claim 9, wherein a protection wall is disposed between the LED module and the driver circuit.

11. The lighting apparatus of claim 10, wherein the protection wall has a reflective layer facing to the LED module.

12. The lighting apparatus of claim 11, wherein reflective layer has a curve surface for scattering a light of the LED module emitted on the reflective layer.

13. The lighting apparatus of claim 11, wherein the protection wall comprises a metal material for carrying heat away to a heat sink.

14. The lighting apparatus of claim 9, wherein a reflective cup and a light passing cover are attached to the inner semi-sphere housing.

15. The lighting apparatus of claim 14, wherein the light passing cover has a lens, wherein the light passing cover is adjustable to change a distance between the lens and the light source to change a diameter of a light beam.

16. The lighting apparatus of claim 1, wherein the rotation shaft has a wiring hole for a connecting wire to pass through, wherein the connecting wire connects the light source to an external power.

17. The lighting apparatus of claim 16, wherein the connecting wire is fixed to a wire limiting structure to prevent pulling of the connecting wire.

18. The lighting apparatus of claim 16, wherein the connecting wire passes through the central hole of the fixing unit.

19. The lighting apparatus of claim 1, wherein the rotation shaft has a wire socket for connecting to a power wire.

20. The lighting apparatus of claim 1, wherein the elastic units comprises three elastic clips.

* * * * *